US011231212B2

(12) United States Patent
Snider et al.

(10) Patent No.: US 11,231,212 B2
(45) Date of Patent: Jan. 25, 2022

(54) REFRIGERANT DISCHARGE HEAT EXCHANGE SYSTEM AND METHOD

(71) Applicant: Johnson Controls Technology Company, Auburn Hills, MI (US)

(72) Inventors: Ryan L. Snider, York, PA (US); Karla D. Alvarez Cavazos, York, PA (US); Nicholas P. Mislak, Bel Air, MD (US)

(73) Assignee: Johnson Controls Technology Company, Auburn Hills, MI (US)

( * ) Notice: Subject to any disclaimer, the term of this patent is extended or adjusted under 35 U.S.C. 154(b) by 191 days.

(21) Appl. No.: 16/386,789

(22) Filed: Apr. 17, 2019

(65) Prior Publication Data

US 2020/0318874 A1 Oct. 8, 2020

Related U.S. Application Data

(60) Provisional application No. 62/829,994, filed on Apr. 5, 2019.

(51) Int. Cl.

| | |
|---|---|
| ***F25B 40/04*** | (2006.01) |
| ***F25B 13/00*** | (2006.01) |
| ***F25D 21/14*** | (2006.01) |

(52) U.S. Cl.

CPC ..... *F25B 40/04* (2013.01); *F25B 13/00* (2013.01); *F25D 21/14* (2013.01)

(58) Field of Classification Search

CPC .... F25B 40/04; F25B 13/00; F25B 2339/047; F25B 40/02; F25B 39/04; F25D 21/14; F24F 13/222; F24F 1/42; F28D 2021/0068; F28D 5/00; F28D 7/106

See application file for complete search history.

(56) References Cited

U.S. PATENT DOCUMENTS

| | | | | |
|---|---|---|---|---|
| 2,471,317 A * | 5/1949 | Fausekarthur | F28D 7/022 165/141 |
| 3,201,950 A * | 8/1965 | Shrader | F25B 41/20 62/197 |
| 4,798,058 A * | 1/1989 | Gregory | F25B 47/022 165/154 |
| 5,351,502 A * | 10/1994 | Gilles | F24D 17/02 62/238.7 |
| 6,338,256 B1 | 1/2002 | Tien | |
| 6,345,514 B1 | 2/2002 | Moon et al. | |

(Continued)

FOREIGN PATENT DOCUMENTS

WO 2017165924 10/2017

OTHER PUBLICATIONS

Packless Industries, "Desuperheater Cans", Website: https://packless.com/products/desuperheaters, 2017-2021.

*Primary Examiner* — Kun Kai Ma

(74) *Attorney, Agent, or Firm* — Fleter Yoder, P.C.

(57) ABSTRACT

A desuperheater of a heating, ventilation, and/or air conditioning (HVAC) system includes a first conduit defining a first fluid flow path configured to receive a refrigerant, and a second conduit defining a second fluid flow path and configured to facilitate heat transfer between the first fluid flow path and the second fluid flow path. The desuperheater also includes an inlet of the second conduit configured to receive collected water into the second fluid flow path. The desuperheater also includes a ventilation hole disposed in the second conduit and configured to vent water vapor from the second fluid flow path.

29 Claims, 8 Drawing Sheets

(56) References Cited

U.S. PATENT DOCUMENTS

| | | | | |
|---|---|---|---|---|
| 6,389,834 | B1 | 5/2002 | LeClear et al. | |
| 6,463,751 | B1 | 10/2002 | Teller | |
| 6,715,312 | B1 | 4/2004 | Teakell | |
| 6,761,039 | B1 | 7/2004 | Gray | |
| 7,013,658 | B2 | 3/2006 | Dobmeier et al. | |
| 7,322,205 | B2 | 1/2008 | Bourne et al. | |
| 7,658,082 | B2 | 2/2010 | Jagusztyn | |
| 7,661,460 | B1 * | 2/2010 | Cowans | F28D 7/106 165/64 |
| 8,100,195 | B2 * | 1/2012 | Tao | F28D 7/10 175/17 |
| 8,408,022 | B2 * | 4/2013 | Stockton, Jr. | F28F 17/005 62/291 |
| 9,513,061 | B2 * | 12/2016 | Choi | F28F 9/02 |
| 2010/0024451 | A1 * | 2/2010 | Leabo | F25B 40/04 62/122 |
| 2010/0229577 | A1 * | 9/2010 | Hong | F28F 1/08 62/190 |
| 2014/0069137 | A1 * | 3/2014 | Wu | F25B 27/00 62/498 |
| 2014/0231042 | A1 | 8/2014 | Curry et al. | |
| 2014/0331703 | A1 | 11/2014 | LaConte | |
| 2015/0198340 | A1 | 7/2015 | Hancock | |
| 2015/0362230 | A1 | 12/2015 | Al-Farayedhi et al. | |
| 2020/0094185 | A1 * | 3/2020 | Iwata | B01D 53/265 |
| 2020/0248963 | A1 * | 8/2020 | Beutler | F26B 21/14 |

* cited by examiner

REFRIGERANT DISCHARGE HEAT EXCHANGE SYSTEM AND METHOD

CROSS-REFERENCE TO RELATED APPLICATIONS

This application claims priority from and the benefit of U.S. Provisional Application Ser. No. 62/829,994, entitled "REFRIGERANT DISCHARGE HEAT EXCHANGE SYSTEM AND METHOD," filed Apr. 5, 2019, which is herein incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. An HVAC system may control the environmental properties of an environment through the control of an airflow delivered to the environment. For example, certain HVAC systems may utilize a vapor compression cycle whereby a refrigerant is compressed by a compressor, condensed by a condenser, expanded by an expansion valve, and routed through an evaporator in which the refrigerant absorbs heat from an air flow blown or drawn over the evaporator. The vaporized refrigerant may then be routed back to the compressor, and the cooled air flow may be directed toward the environment for conditioning the environment.

In traditional embodiments, the refrigerant may be superheated by the compressor and may include other temperature or pressure properties caused by the above-described HVAC components that negatively impact, for example, an efficiency and/or life time of the HVAC system.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates to a desuperheater of a heating, ventilation, and/or air conditioning (HVAC) system. The desuperheater includes a first conduit defining a first fluid flow path configured to receive a refrigerant, and a second conduit defining a second fluid flow path and configured to facilitate heat transfer between the first fluid flow path and the second fluid flow path. The desuperheater also includes an inlet of the second conduit configured to receive collected water into the second fluid flow path. The desuperheater also includes a ventilation hole disposed in the second conduit and configured to vent water vapor from the second fluid flow path.

The present disclosure also relates to a heating, ventilation, and/or air conditioning (HVAC) system. The HVAC system includes a discharge line through which a refrigerant flows, and a casing surrounding a portion of the discharge line and defining a second fluid flow path between the casing and the portion of the discharge line. The casing includes an inlet configured to receive collected water into the second fluid flow path, and the casing includes ventilation holes configured to vent water vapor from the second fluid flow path.

The present disclosure also relates to a desuperheater of a heating, ventilation, and/or air conditioning (HVAC) unit. The desuperheater includes a conduit defining a first fluid flow path configured to receive a refrigerant. The desuperheater also includes a casing surrounding the conduit and defining a second fluid flow path between the casing and the conduit, where the casing includes an inlet configured to receive condensate water, rain water, or both into the second fluid flow path. The desuperheater also includes a plate disposed adjacent an inlet of the second fluid flow path and configured to enable, in response to thermal expansion of the plate, a flow of the condensate water, the rain water, or both through the inlet and into the second fluid flow path.

DETAILED DESCRIPTION

Figure 1:
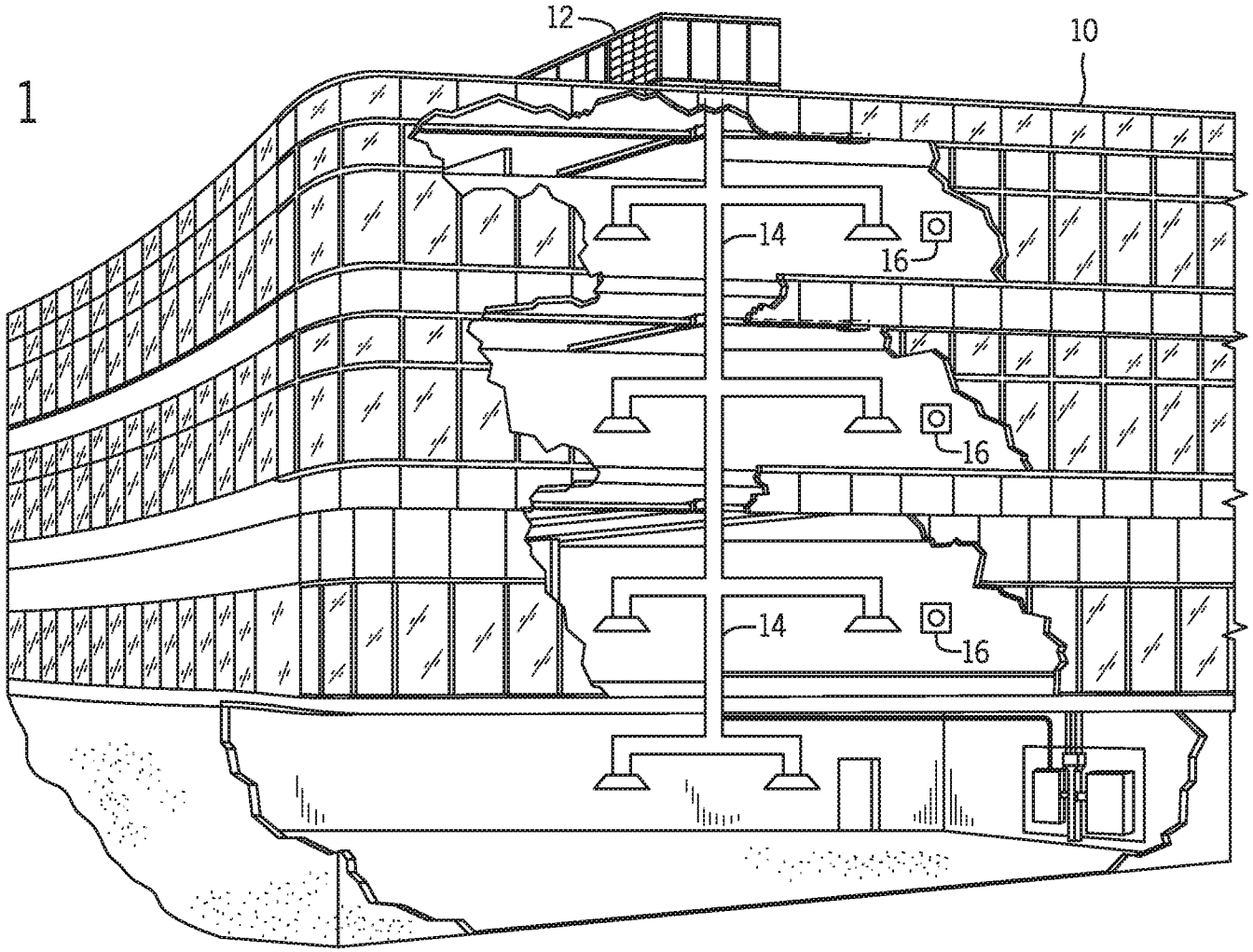
FIG. 1 is a schematic of an HVAC system for building environmental management that includes an HVAC unit, in accordance with an aspect of the present disclosure.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments.

The present disclosure is directed toward a heat exchanger configured to cool a refrigerant discharge from a compressor or condenser. More particularly, the present disclosure is directed toward a desuperheater configured to desuperheat a refrigerant discharge from a compressor or condenser.

Certain HVAC systems may include a compressor configured to compress a refrigerant. In one example, an HVAC system includes a vapor compression cycle having a compressor configured to compress the refrigerant to generate superheated vapor, a condenser configured to receive the compressed refrigerant and to condense the compressed refrigerant from a gaseous to a saturated liquid state, an expansion valve configured to receive the condensed refrigerant and to expand the refrigerant, and an evaporator configured to receive the expanded refrigerant and to utilize the expanded refrigerant to cool an air flow blown or drawn over the evaporator. It is now recognized that, in certain systems, the superheated vapor generated by the compressor may reduce an efficiency or life cycle of the HVAC system. In accordance with present embodiments, the efficiency or life cycle of the HVAC system may be improved by desuperheating the refrigerant.

In accordance with present embodiments, a desuperheater may be configured to receive the refrigerant discharged from the compressor or the condenser. In some embodiments, the HVAC system may include two installations of the presently disclosed desuperheater, one downstream from the compressor and another downstream from the condenser. The presently disclosed desuperheater may be configured to receive the refrigerant discharge, and to cool the refrigerant discharge via cooling water including rain water, condensate water, or both.

For example, the desuperheater may include a first conduit, which may be a casing, surrounding a second conduit, where the first conduit is configured to receive the refrigerant discharge from the compressor. The casing may define a flow path between the casing and an outer surface of the conduit, whereby the flow path is configured to receive the cooling water. Heat exchange fins may be disposed within the flow path configured to receive the cooling water. For example, the heat exchange fins may be coupled to, or integrally formed with, the conduit along the outer surface of the conduit. The cooling water may extract heat from the refrigerant flowing through the conduit, for example via conductive heat transfer from the conduit and/or the heat exchange fins, and the cooling water may be output through an outlet of the desuperheater. In some embodiments, the casing may include ventilation holes in an upper end of the casing. The ventilation holes may be configured to enable venting of water vapor generated during the above-described heat transfer.

Further, the desuperheater may include an inlet valve configured to control a flow of the cooling water through an inlet of the desuperheater to the flow path defined between the casing and the outer surface of the conduit, for example to enable or disable the flow to the inlet. In some embodiments, the valve may include a bi-metallic plate formed by a first metallic portion having a first coefficient of thermal expansion and a second metallic portion having a second coefficient of thermal expansion different than the first coefficient of thermal expansion. The first and second metallic portions may be bound together by fixed connections on opposing ends of the bi-metallic plate. That is, the first and second metallic portions may be stacked together, one on top of the other, and fixed connections may extend around both of the first and second metallic portions at opposing ends of the bi-metallic plate. The bi-metallic plate may thermally expand as a temperature of the bi-metallic plate is increased. The temperature of the bi-metallic plate may be increased via changes to an atmospheric or environmental temperature surrounding the bi-metallic plate. Since the first and second metallic portions of the bi-metallic plate include different coefficients of thermal expansion, the first metallic portion may thermally expand more quickly than the second metallic portion in response to an increased temperature.

By including metallic portions with different coefficients of thermal expansion, and by binding the metallic portions via the above-described fixed connections, thermal expansion may cause the bi-metallic plate to warp. The warping may be leveraged to enable the flow of cooling water into the desuperheater or disable the flow of the cooling water into the desuperheater based on the temperature of the bi-metallic plate, which is based on the environmental temperature as noted above. Accordingly, the flow of the cooling water into the flow path of the desuperheater may be disabled in low temperature conditions that may otherwise cause freezing of the cooling water within the desuperheater. That is, the inlet valve having the bi-metallic plate may be utilized to block pipe freezing conditions in winter months, or when environmental temperature is low and could cause freezing. These and other features will be described in detail below with reference to the drawings.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, airflow, pressure, air quality, and so forth. For example, an HVAC system as used herein is defined as conventionally understood and as further described herein. Components or parts of an HVAC system may include, but are not limited to, all, some of, or individual parts such as a heat exchanger, a heater, an airflow control device, such as a fan, a sensor configured to detect a climate characteristic or operating parameter, a filter, a control device configured to regulate operation of an HVAC system component, a component configured to enable regulation of climate characteristics, or a combination thereof. An HVAC system is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an airflow is passed to condition the airflow before the airflow is supplied to the building. In the illustrated embodiment, the HVAC unit 12 is a rooftop unit (RTU) that conditions a supply air stream, such as environmental air and/or a return airflow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
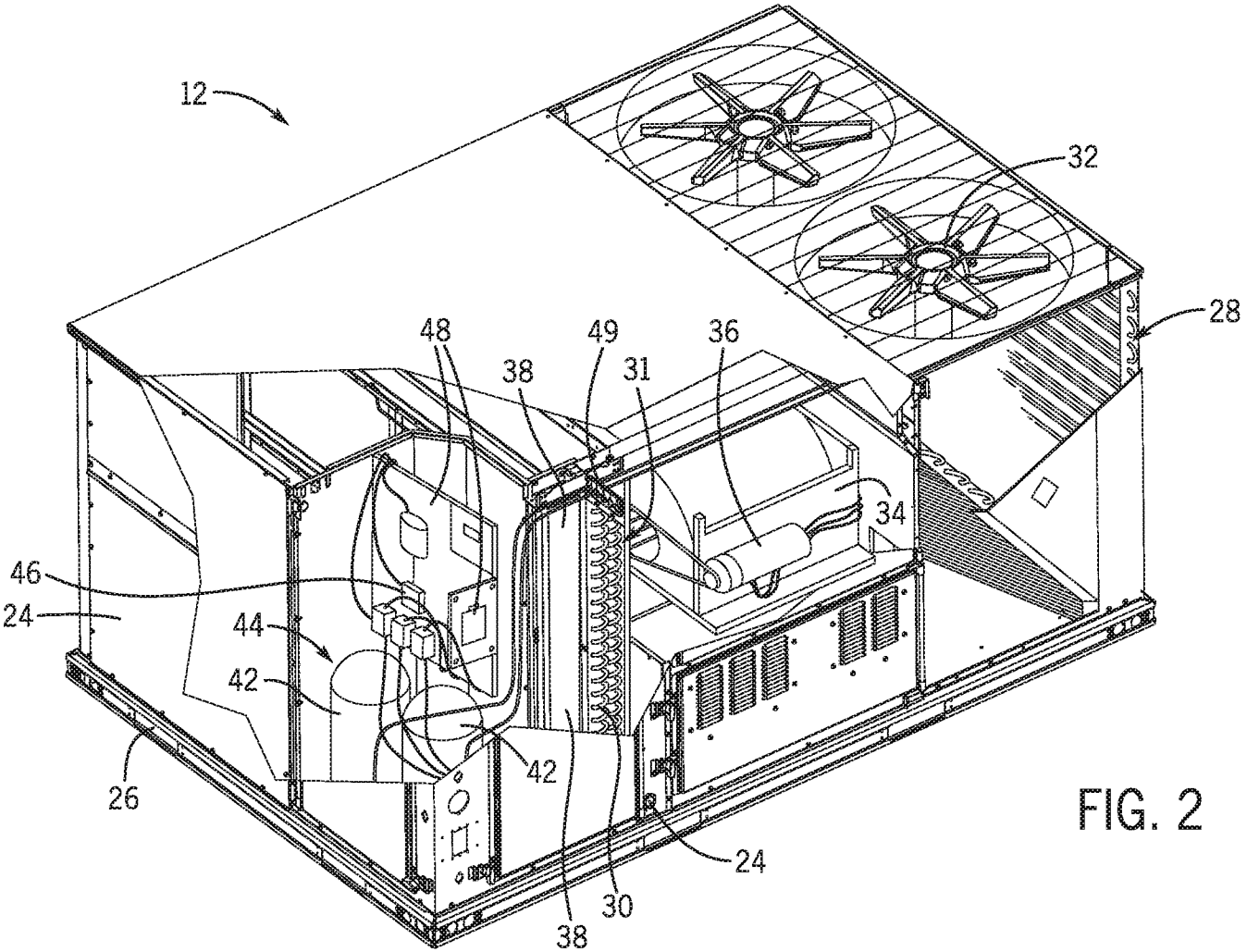
FIG. 2 is a perspective view of an HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the airflows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned airflows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
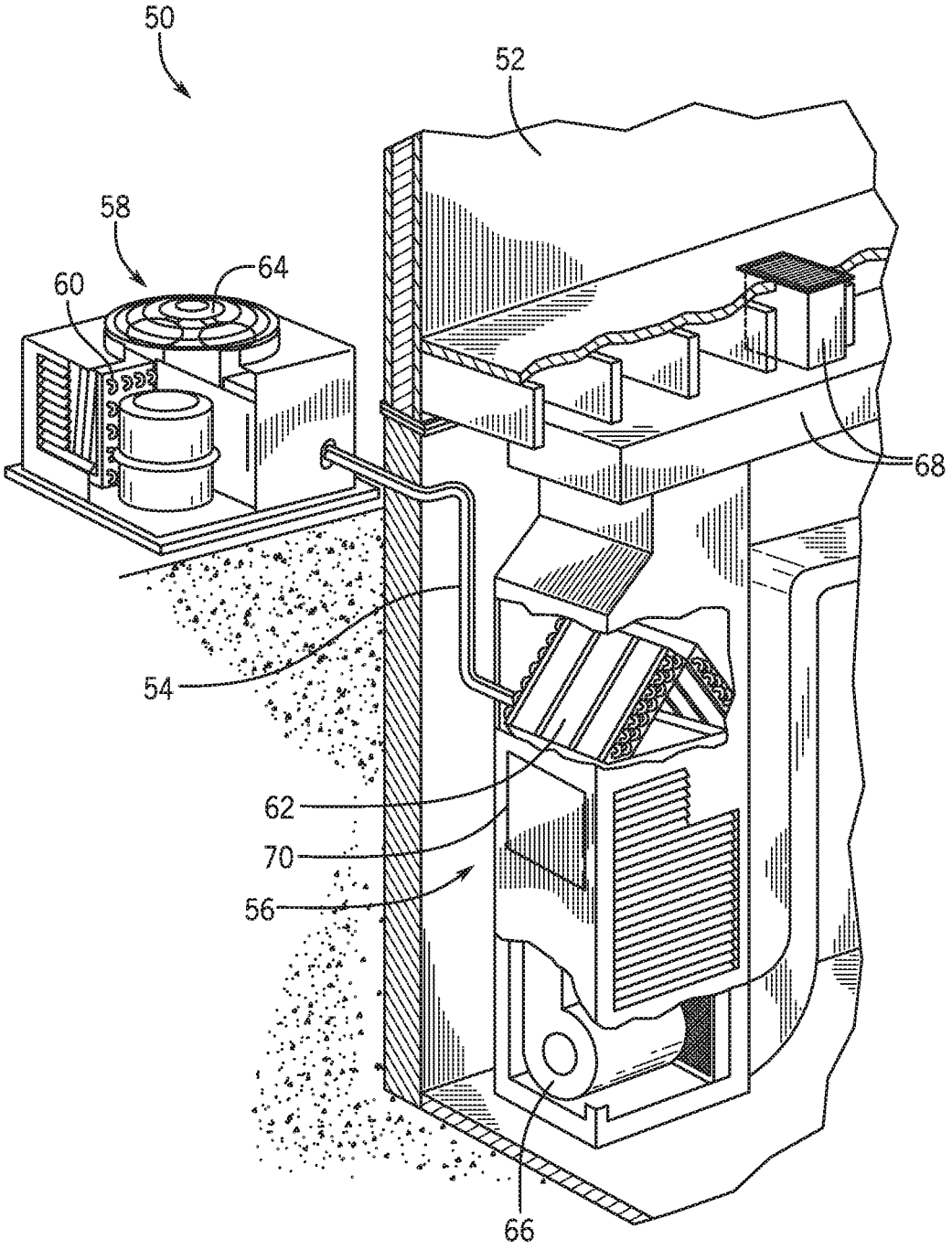
FIG. 3 is a cutaway, perspective view of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit 56 functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
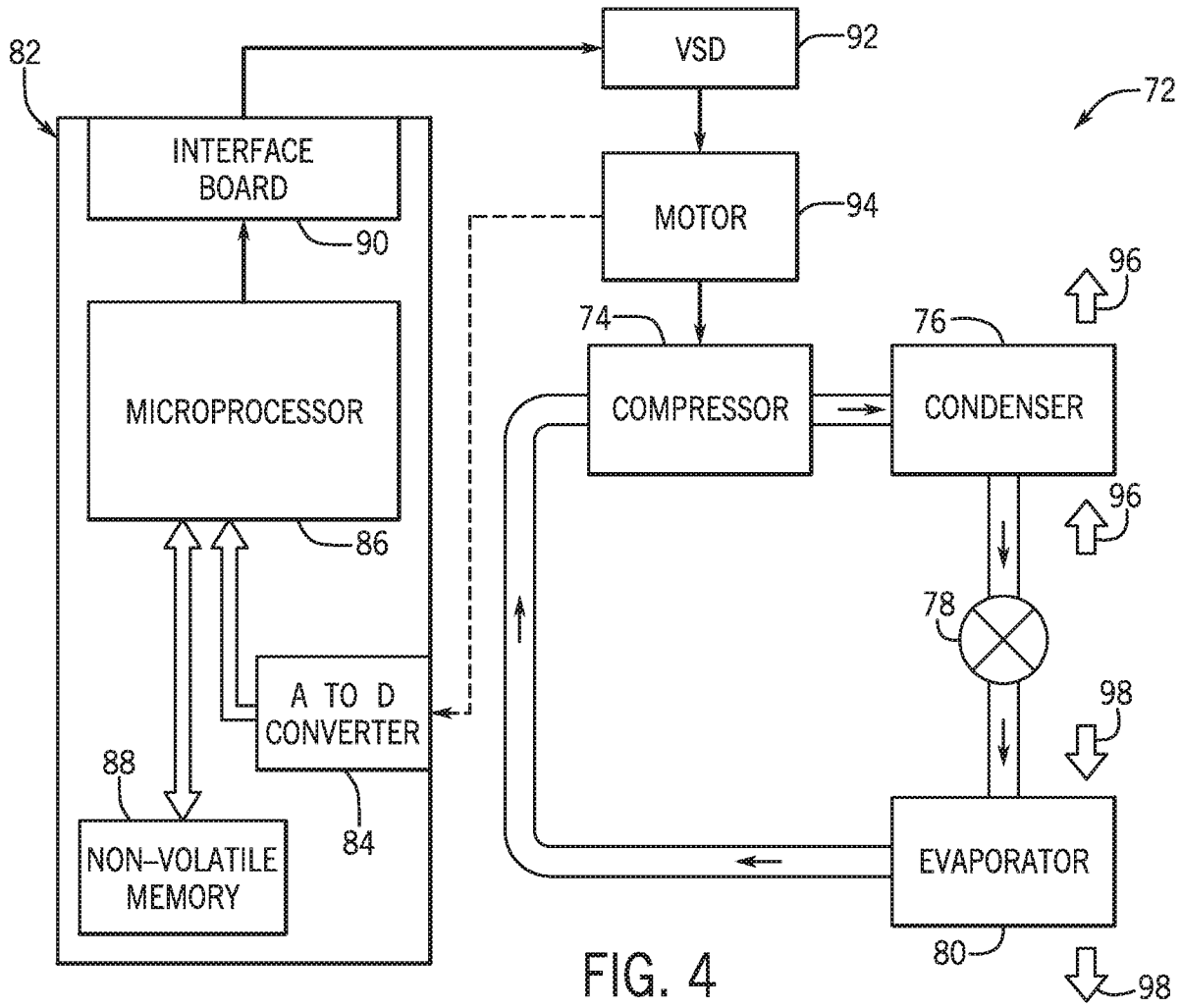
FIG. 4 is a schematic of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As set forth above, embodiments of the present disclosure are directed toward a heat exchanger configured to cool a refrigerant discharge from a compressor or condenser. More particularly, the present disclosure is directed toward a desuperheater configured to desuperheat a refrigerant discharge from a compressor or condenser. The desuperheater is incorporated into each of FIGS. 1-4 above, as described in detail below with reference to FIGS. 5-14. In general, the desuperheater may receive a compressed refrigerant and recycled rain and/or condensate water, and may route the compressed refrigerant and recycled rain and/or condensate water in a heat exchange relation to one another. That is, the desuperheater may utilize the recycled rain and/or condensate water to cool the compressed refrigerant. The desuperheater may include heat exchange fins to improve heat transfer, and ventilation openings to enable water vapor to exit the desuperheater. Further, the desuperheater may include a valve, such as a bi-metallic valve, configured to block a flow of the recycled rain and/or condensate water in temperature conditions that could cause frozen pipes if not for the valve. These and other features of the desuperheater will be discussed in detail below, with reference to FIGS. 5-14.

Figure 5:
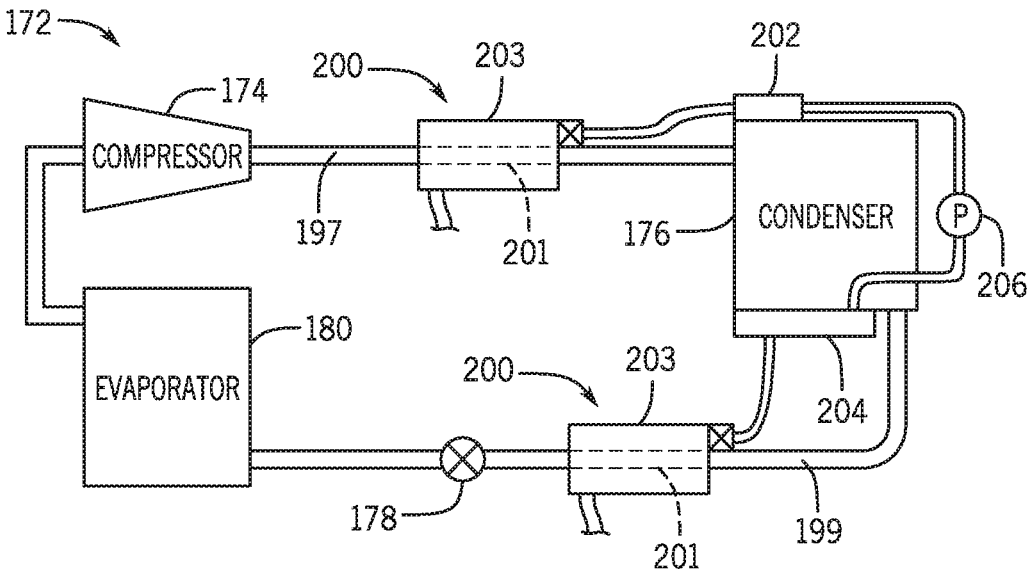
FIG. 5 is a schematic of a portion of the vapor compression system of FIG. 4 having a desuperheater, in accordance with an aspect of the present disclosure.

FIG. 5 is a schematic of an embodiment of a portion of a vapor compression system 172 having at least one desuperheater 200. In the illustrated embodiment, the vapor compression system 172 includes a compressor 174, a condenser 176, an expansion valve 178, and an evaporator 180. Operation of the vapor compression system 172 is similar to, or the same as, the vapor compression system 72 described above with respect to FIG. 4. In the illustrated embodiment, the vapor compression system 172 includes two desuperheaters 200, one positioned between the compressor 174 and the condenser 176, and the other positioned between the condenser 200 and the expansion valve 178.

Focusing first on the embodiment disposed between the compressor 174 and the condenser 176, the desuperheater 200 may be configured to receive rain water gathered in a rain collection pan 202, condensate water gathered in a drain pan 204, or both. The rain water and/or the condensate water may be referred to collectively or individually as collected water. The desuperheater 200 may include a conduit 201 configured to receive compressed refrigerant from a compressor discharge line 197 of the compressor 174. The compressed refrigerant may be superheated by the compressor 174, and the desuperheater 200 may be configured to cool, or desuperheat, the compressed refrigerant. The desuperheater 200 also includes a casing 203, which may be referred to as an additional conduit, surrounding the conduit 201. A water flow path may be defined between the casing 203 and an outer surface of the conduit 201. The water flow path defined between the casing 203 and the conduit 201 may be configured to receive the condensate water from the drain pan 204, the rain water from the rain collection pan 202, or both. In certain embodiments, a pump 206 may be employed to pump condensate water from the condensate collection pan 204 to the desuperheater 200, either directly or first through the rain collection pan 202. A similar pump may be utilized in another embodiment for pumping water in an opposing direction or route, for example to pump the rain water toward the condensate collection pan 204. As the desuperheater guides the rain and/or condensate water through the water flow path and the refrigerant through the conduit 201, heat may be transferred from the compressed refrigerant to the rain and/or condensate water, thereby cooling the compressed refrigerant.

The desuperheater 200 downstream of the condenser 176 may operate in the same or a similar manner. That is, the refrigerant exiting the condenser 176 may be superheated or heated above a desired temperature, and the desuperheater 200 receiving the refrigerant from a condenser discharge line 199 of the condenser 176 may operate to cool the refrigerant. The conduit 201 may receive the condensed refrigerant, and the flow path between the casing 203 and the conduit 201 may receive the rain and/or condensate water. As will be described in detail below with respect to later drawings, a valve may control water input to the desuperheater 200, an outlet may enable the water to exit the desuperheater 200, and ventilation openings may enable water vapor to exit the water flow path of the desuperheater 200 during operation of the desuperheater.

In certain embodiments, the conduit 201 of the desuperheater 200 may be integral with the compressor discharge line 197 or the condenser discharge line 199, and the casing 203 may be formed or disposed around the conduit 201. In other embodiments, the conduit 201 may be separate from the compressor discharge line 197 or the condenser discharge line 199. For example, the conduit 201 may be separate from the discharge line 197 or 199 and may include a different material having a higher heat transfer coefficient than the discharge line 197 or 199. Including the conduit 201 having the material with the higher heat transfer coefficient may as described above may enhance a cooling effect of the desuperheater 200.

Figure 6:
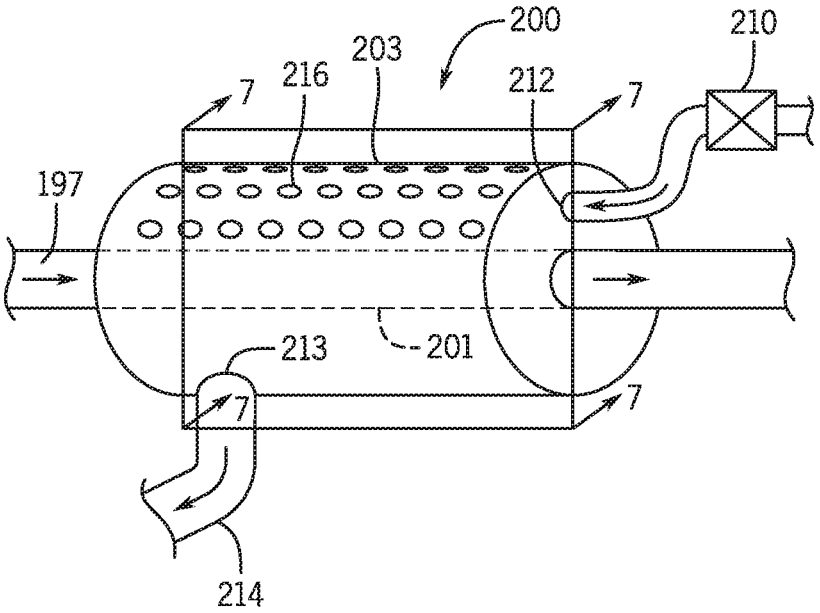
FIG. 6 is a perspective view of the desuperheater of FIG. 5, in accordance with an aspect of the present disclosure.

FIG. 6 is a perspective view of an embodiment of the desuperheater 200 of FIG. 5. As shown, the desuperheater includes a valve 210 configured to enable or disable a flow of the rain and/or condensate water to an inlet 212 of the desuperheater 200, more specifically to the inlet 212 of the water flow path disposed between the casing 203 of the desuperheater 200 and the conduit 201 of the desuperheater. The conduit 201 fluidly separates the refrigerant from the space in the desuperheater 200 between the conduit 201 and the outer casing 203. Thus, a flow of condensate and/or rain water in the space between the conduit 201 and the casing 203 does not mix with the refrigerant. The casing 203 includes ventilation openings 216 facing upwardly, with respect to gravity, and configured to enable water vapor to vent from the desuperheater 200. For example, as the water flowing through the desuperheater 200 extracts heat from the refrigerant flowing through the desuperheater 200, a portion of the water may be vaporized. The ventilation openings 216 in the illustrated embodiment are disposed only on an upwards facing segment of the casing 203, such that liquid water within the desuperheater 200 does not flow through the ventilation openings 216. Instead, the liquid water is guided toward a downward facing outlet 213 of the desuperheater, and in some embodiments through an outlet line 214 coupled to the outlet 213. The outlet line 214 may safely dispose of the water, or the outlet line 214 may route the water toward a drain pan or rain collection pan to recycle the water. In general, the ventilation openings 216 may safely remove water vapor from the water flow path, which enhances heat transfer and, thus, effectiveness of the desuperheater 200.

Figure 7:
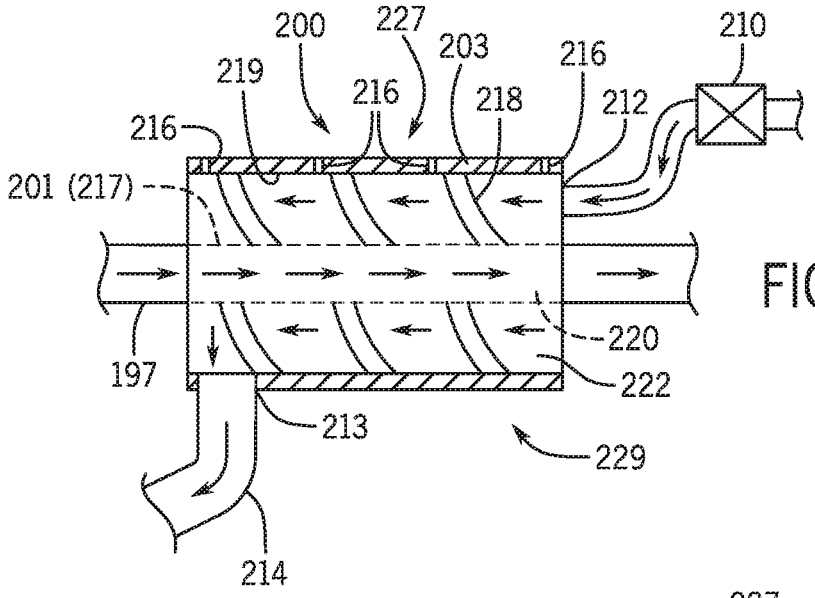
FIG. 7 is a cross-sectional axial view of the desuperheater of FIG. 6, taken along line 7-7 in FIG. 6, in accordance with an aspect of the present disclosure.

FIG. 7 is a cross-sectional axial view of an embodiment of the desuperheater 200 of FIG. 6, taken along line 7-7 in FIG. 6. A water flow path 222, which is configured to receive the rain and/or condensate water via the inlet 212 of the desuperheater 200, is shown in the illustrated embodiment. As previously described, the water flow path 222 is configured to receive the condensate and/or rain water, and is separated from a flow of the refrigerant via the conduit 201 of the desuperheater 200. That is, the water flow path 222 may be defined between an outer surface 217 of the conduit 201 and an inner surface 219 of the casing 203. As shown, heat exchange fins 218 of the desuperheater 200 may extend within the water flow path 222. In some embodiments, the heat exchange fins 218 may include a material with a relatively high heat transfer coefficient, such as certain metallic materials. The conduit 201 may also include a material with a high heat transfer coefficient, and the heat exchange fins 218 may couple to, or be integrally formed with, the conduit 201. Accordingly, heat may be transferred from the refrigerant, to the conduit 201, and to the water, and/or from the refrigerant, to the conduit 201, to the heat exchange fins 218, and to the water. The heat exchange fin (or fins) 218 may be disposed in a helical arrangement, a spiral arrangement, a swirl arrangement, a threaded arrangement, or some other arrangement configured to improve heat transfer, as will be described with reference to later drawings. For example, in the illustrated embodiment, a single heat exchange fin 218 may extend in a spiral or helical route about the conduit 201, which may increase an amount of time the water takes to travel from the inlet 212 to the desuperheater 200, through the water flow path 222 of the desuperheater 200, and to the outlet 213 of the desuperheater 200.

Figure 8:
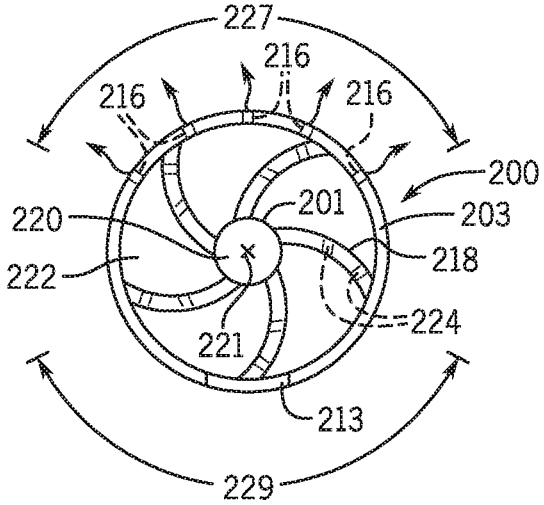
FIG. 8 is a cross-sectional radial view of the desuperheater of FIG. 6, in accordance with an aspect of the present disclosure.

FIG. 8 is a cross-sectional radial view of an embodiment of the desuperheater of FIG. 6. In the illustrated embodiment, the desuperheater 200 includes several heat exchange fins 218 extending within the water flow path 222. For example, each heat exchange fin 218 may include a curved profile along an axial cross-section through the desuperheater 200, as shown, and the curved profile may extend in a linear direction from one end of the desuperheater 200 to the other. That is, each fin 218 may extend in an axial direction along a longitudinal axis 221 extending through the conduit 201 of the desuperheater 200. In the illustrated embodiment, each fin 218 includes perforations 224 to enable the water to flow from one side of the fin 218 to the other. The perforations 224 may include circular holes, slots extending in the axial direction along the longitudinal axis 221, or both.

Figure 9:
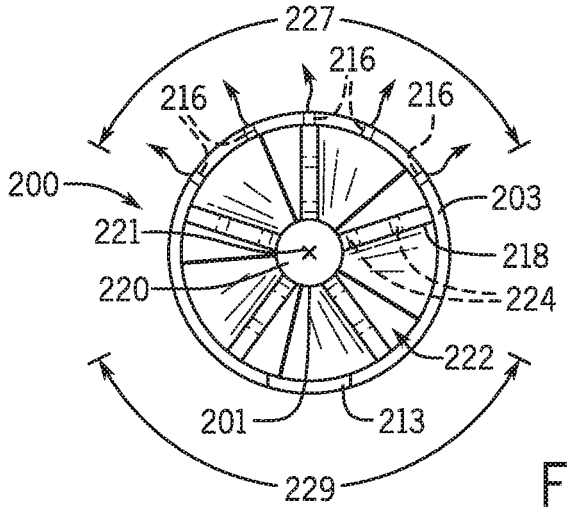
FIG. 9 is another cross-sectional radial view of the desuperheater of FIG. 6, in accordance with an aspect of the present disclosure.

FIG. 9 is another cross-sectional radial view of an embodiment of the desuperheater 200 of FIG. 6. In the illustrated embodiment, the desuperheater 200 includes several heat exchange fins 218 extending within the water flow path 222. Each heat exchange fin 218 includes a substantially straight cross-sectional profile in a radial direction relative to the longitudinal axis 221. However, each fin 218 may twist about the longitudinal axis 221 as the fin 218 extends along the longitudinal axis 221 from one end of the desuperheater 200 to the other. The fins 218 in the illustrated embodiment may include perforations 224.

In each of FIGS. 7-9, the ventilation openings 216 are disposed through an upwards facing segment 227 of the desuperheater 200 relative to gravity, and the water outlet 213 is disposed in a downward facing segment 229 of the desuperheater 200. Accordingly, spent water can be routed out of the desuperheater 200 via the outlet 213, and water vapor can be vented from the desuperheater 200 via the ventilation openings 216. By venting the water vapor, the desuperheater 200 can more readily receive additional water for cooling the refrigerant flowing through the conduit 201. That is, the ventilation openings 216 disposed in the upwards facing segment 227, by venting water vapor, improves heat transfer effectiveness of the desuperheater 200.

Figure 10:
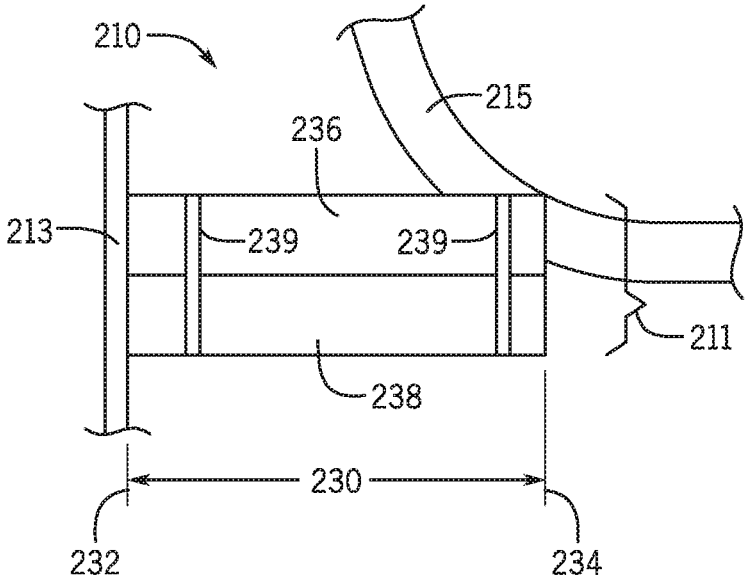
FIG. 10 is a schematic of an inlet valve formed by a bi-metallic plate and for use in the desuperheater of FIG. 6, in accordance with an aspect of the present disclosure.

As illustrated in, and previously described with respect to, FIG. 6, a valve 210 of the desuperheater 200 may be utilized to enable or disable a flow of the water to or through the desuperheater 200. For example, in low temperature conditions, the inlet valve 210 may block a flow of the condensate and/or rain water to the desuperheater 200 in order to block pipe freezes. FIG. 10 is a schematic of an embodiment of the inlet valve 210 formed by a bi-metallic plate 211, for use in the desuperheater 200 of FIG. 6, and for blocking a flow of water through a supply water line 215. That is, the supply water line 215 in FIG. 10 may supply rain and/or condensate water to a desuperheater, as previously described, and the illustrated bi-metallic plate 211 may be used to enable or disable the flow of water through the supply water line 215.

The bi-metallic plate 211 of the inlet valve 210 in FIG. 10 includes a first metallic portion 236 and a second metallic portion 238. The first metallic portion 236 may include a first coefficient of thermal expansion, and the second metallic portion 238 may include a second coefficient of thermal expansion different than the first coefficient of thermal expansion of the first metallic portion 236. The first metallic portion 236 and the second metallic portion 238 may be coupled via fixed connections 239 on either end 232, 234 of the bi-metallic plate 211 of the inlet valve 210, where the ends 232, 234 refer to either end of a length 230 of the bi-metallic plate 211. At relatively low temperatures, the bi-metallic plate 211 may include a substantially straight orientation, as the relatively low temperature is not high enough to cause either of the portions 236, 238 to thermally expand. The illustrated in FIG. 10 corresponds to a state of the bi-metallic plate 211 at a relatively low temperature.

Figure 11:
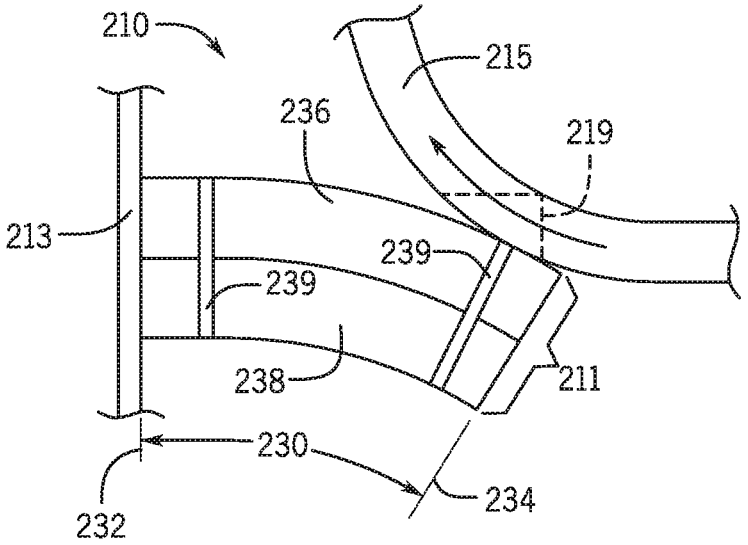
FIG. 11 is a schematic of the inlet valve of FIG. 10 after thermal expansion of the bi-metallic plate, in accordance with an aspect of the present disclosure.

As a temperature surrounding the bi-metallic plate 211 of the inlet valve 210 increases, the first metallic portion 236 may thermally expand at a faster rate, or beginning at a lower temperature, than the second metallic portion 238. Because the first metallic portion 236 and the second metallic portion 238 include fixed connections 239 and the first metallic portion 236 thermally expands in response to a lower temperature than the second metallic portion 238, the bi-metallic plate 211 of the inlet valve 210 may warp as a temperature surrounding it increases. FIG. 11 is a schematic of an embodiment of the inlet valve 210 of FIG. 10 after thermal expansion of the bi-metallic plate 211. As the bi-metallic plate 211 of the inlet valve 210 warps, a flow of the water past the bi-metallic plate 211 and through the supply water line 215 may be enabled. That is, the flow of water may be permitted at higher temperatures that cause the bi-metallic plate 211 of the inlet valve 210 to warp, and may be blocked at lower temperatures when the bi-metallic plate 211 of the inlet valve 210 does not warp. A feature 223 of the supply water line 215, such as a flexible or hinged flap, may enable the bi-metallic plate 211 to restrict a flow path of the supply water line 215 when the bi-metallic plate 211 is in the unexpanded state illustrated in FIG. 10. The feature 223, such as the flexible or hinged flap, may be repositioned as the bi-metallic plate 211 flexes or bends away from the supply water line 215 at relatively high temperatures, thereby enabling a flow of water through the supply water line 215, as illustrated in FIG. 11. Thus, the inlet valve 210 may be an entirely mechanical device formed by the bi-metallic plate 211, which can enable or disable a flow of the water through the supply water line 215 and to an inlet of a desuperheater without electric or electronic power and control.

Figure 12:
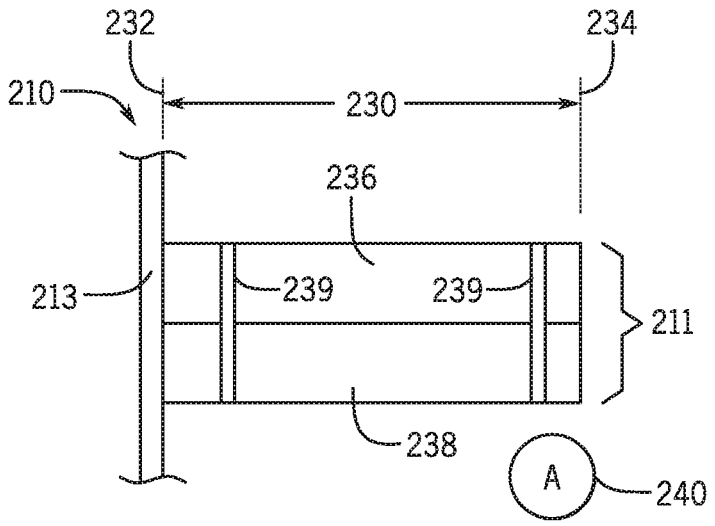
FIG. 12 is a schematic of an inlet valve formed by a bi-metallic plate and an actuator, and for use in the desuperheater of FIG. 6, in accordance with an aspect of the present disclosure.
Figure 13:
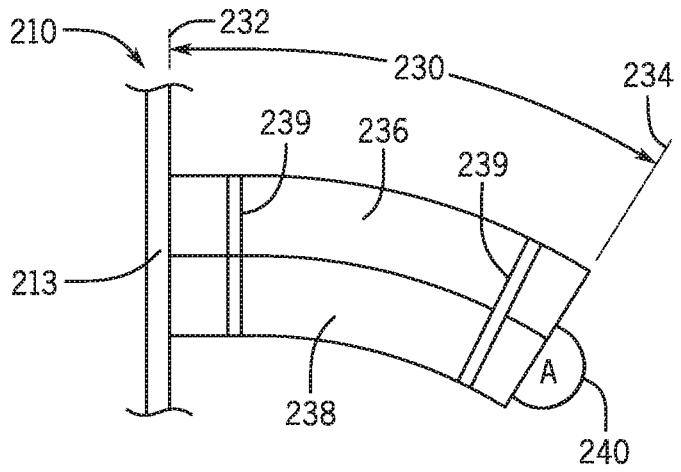
FIG. 13 is a schematic of the inlet valve of FIG. 12 after thermal expansion of the bi-metallic plate, in accordance with an aspect of the present disclosure.

FIG. 12 is a schematic of an embodiment of the inlet valve 210 formed by the bi-metallic plate 211 and an actuator 240. In the illustrated embodiment, the bi-metallic plate 211 may operate in a similar manner as described above with respect to FIGS. 10 and 11, but the inlet valve 210 may include the actuator 240, which is configured to enable or disable the flow of water based on a contact between the bi-metallic plate 211 and the actuator 240. That is, the bi-metallic plate 211 may warp in response to a temperature increase described above, causing the bi-metallic plate 211 to contact the actuator 240. FIG. 13 is a schematic of an embodiment of the inlet valve of FIG. 12 after thermal expansion of the bi-metallic plate 211, whereby the bi-metallic plate 211 contacts the actuator 240. In response to the contact, the actuator 240 may enable the flow of water to the desuperheater. The actuator 240 may be a mechanical device such as a gate or switch, or an electric or electronic device.

Figure 14:
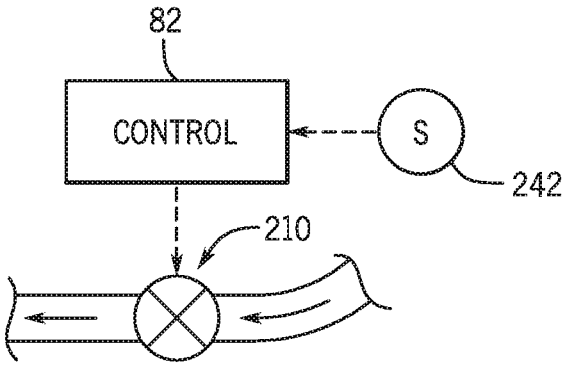
FIG. 14 is a schematic of a controller and an inlet valve for use in the desuperheater of FIG. 6, in accordance with an aspect of the present disclosure.

FIG. 14 is a schematic of an embodiment of a controller 82, for example having a processor and memory as described above with respect to FIG. 4, and an inlet valve 210 for use in the desuperheater of FIG. 6. In the illustrated embodiment, the controller 82 may receive sensor feedback from a sensor 242, such as a temperature sensor, and may control opening and closing of the inlet valve 210 based on the temperature surrounding the valve 210 and/or desuperheater.

As described above, and in accordance with the present disclosure, a desuperheater of a vapor compression system may be utilized to desuperheat a compressed and/or condensed refrigerant. The desuperheater may include heat exchange fins configured to enhance heat transfer between the refrigerant and recycled rain and/or condensate water. The desuperheater may also include ventilation openings configured to enable water vapor to vent from a water flow path of the desuperheater. The desuperheater may also include an inlet valve, such as a bi-metallic plate, that enables or disables a flow of water into the desuperheater based on a temperature surrounding the desuperheater. Thus, frozen pipe conditions are blocked by the inlet valve, without allocating power resources in certain embodiments to control a flow of water through the desuperheater.

While only certain features and embodiments of the disclosure have been illustrated and described, many modifications and changes may occur to those skilled in the art, such as variations in sizes, dimensions, structures, shapes and proportions of the various elements, values of parameters including temperatures and pressures, mounting rail arrangements, use of materials, colors, orientations, etc., without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A desuperheater of a heating, ventilation, and/or air conditioning (HVAC) system, comprising:

a first conduit defining a first fluid flow path configured to receive a refrigerant;

a second conduit defining a second fluid flow path and configured to facilitate heat transfer between the first fluid flow path and the second fluid flow path;

an inlet of the second conduit configured to receive collected water into the second fluid flow path; and a ventilation hole disposed in the second conduit and configured to vent water vapor from the second fluid flow path.

2. The desuperheater of claim 1, wherein the second conduit comprises a casing surrounding the first conduit, and the second fluid flow path is defined between the casing and the first conduit.

3. The desuperheater of claim 1, wherein the inlet is configured to receive the collected water from a condensate water collector, a rain water collector, or both.

4. The desuperheater of claim 1, wherein the second conduit comprises a plurality of ventilation holes disposed therein and configured to vent water vapor therefrom.

5. The desuperheater of claim 1, comprising heat exchange fins extending radially between the first conduit and the second conduit, and within the second fluid flow path.

6. The desuperheater of claim 5, wherein the heat exchange fins comprise perforations configured to enable a flow of the collected water across the heat exchange fins and through the second fluid flow path.

7. The desuperheater of claim 5, wherein the heat exchange fins comprise curved cross-sectional profiles between the first conduit and the second conduit.

8. The desuperheater of claim 1, comprising a heat exchange fin extending radially between the first conduit and the second conduit, wherein the heat exchange fin comprises a spiral or helical shape about a longitudinal axis of the desuperheater.

9. The desuperheater of claim 1, comprising a plate disposed adjacent the inlet of the second fluid flow path and configured to enable, in response to thermal expansion of the plate, a flow of the collected water to the inlet.

10. The desuperheater of claim 9, wherein the plate includes a bi-metallic plate having a first metallic portion with a first coefficient of thermal expansion, and having a second metallic portion with a second coefficient of thermal expansion different than the first coefficient of thermal expansion.

11. The desuperheater of claim 10, comprising fixed connections on opposing ends of the bi-metallic plate, wherein the fixed connections are configured to bind the first metallic portion to the second metallic portion and to cause the bi-metallic plate to bend in response to the bi-metallic plate reaching a first temperature threshold to enable the flow of the collected water through a collected water supply line and to the inlet.

12. The desuperheater of claim 1, comprising a water outlet disposed through the second conduit and fluidly coupled with the second fluid flow path, wherein the water outlet is disposed on an underside of the second conduit and the ventilation hole is disposed on an upperside of the second conduit opposite to the underside with respect to gravity.

13. The desuperheater of claim 1, comprising an electronic valve fluidly coupled between the inlet of the second fluid flow path and a collected water supply line, wherein the electronic valve is configured to be opened in response to a control command to enable a flow of the collected water through the collected water supply line, to the inlet, and into the second fluid flow path.

14. The desuperheater of claim 1, wherein the first conduit is integral with a portion of a compressor discharge line or a condenser discharge line.

15. A heating, ventilation, and/or air conditioning (HVAC) system, comprising:

a collected water source;

a discharge line through which a refrigerant flows; and a casing surrounding a portion of the discharge line and defining a second fluid flow path between the casing and the portion of the discharge line, wherein the casing includes an inlet coupled to the collected water source and configured to receive collected water from the collected water source into the second fluid flow path to enable the collected water to cool the refrigerant in the discharge line, and wherein the casing includes ventilation holes configured to vent water vapor from the second fluid flow path.

16. The HVAC system of claim 15, wherein the portion of the discharge line is separate from, and coupled to, an additional portion of the discharge line upstream of the portion of the discharge line.

17. The HVAC system of claim 16, wherein the portion of the discharge line comprises a material having a higher heat transfer coefficient than the additional portion of the discharge line.

18. The HVAC system of claim 15, comprising a compressor and a condenser, wherein the discharge line is a compressor discharge line from the compressor or a condenser discharge line from the condenser.

19. The HVAC system of claim 15, comprising heat exchange fins extending radially between the portion of the discharge line and the casing, and within the second fluid flow path.

20. The HVAC system of claim 19, wherein the heat exchange fins comprise perforations configured to enable a flow of the collected water across the heat exchange fins and through the second fluid flow path.

21. The HVAC system of claim 19, wherein the heat exchange fins comprise curved cross-sectional profiles between the portion of the discharge line and the casing.

22. The HVAC system of claim 15, comprising a bi-metallic plate disposed adjacent the inlet of the second fluid flow path and configured to enable, in response to thermal expansion of the bi-metallic plate, a flow of the collected water to the inlet.

23. The HVAC system of claim 22, wherein the bi-metallic plate comprises:

a first metallic portion having a first coefficient of thermal expansion;

a second metallic portion having a second coefficient of thermal expansion different than the first coefficient of thermal expansion; and fixed connections on opposing ends of the bi-metallic plate and configured to bind the first metallic portion to the second metallic portion, and configured to cause the bi-metallic plate to bend in response to the bi-metallic plate reaching a first temperature threshold to enable the flow of the collected water to the inlet.

24. The HVAC system of claim 15, comprising a water outlet disposed through the casing and fluidly coupled with the second fluid flow path, wherein the water outlet is disposed on an underside of the casing and the ventilation holes are disposed on an upperside of the casing opposite to the underside with respect to gravity.

25. A desuperheater of a heating, ventilation, and/or air conditioning (HVAC) unit, comprising:

a conduit defining a first fluid flow path configured to receive a refrigerant;

a casing surrounding the conduit and defining a second fluid flow path between the casing and the conduit, wherein the casing includes an inlet configured to receive condensate water, rain water, or both into the second fluid flow path; and a plate disposed adjacent the inlet of the second fluid flow path and configured to enable, in response to thermal expansion of the plate, a flow of the condensate water, the rain water, or both through the inlet and into the second fluid flow path.

26. The desuperheater of claim 25, wherein the casing includes ventilation holes configured to vent water vapor from the second fluid flow path.

27. The desuperheater of claim 26, comprising a water outlet disposed through the casing and fluidly coupled with the second fluid flow path, wherein the water outlet is disposed on an underside of the casing and the ventilation holes are disposed on an upperside of the casing opposite to the underside with respect to gravity.

28. The desuperheater of claim 25, wherein the conduit is integral with a compressor discharge line or a condenser discharge line.

29. The desuperheater of claim 25, comprising heat exchange fins extending radially between the conduit and the casing.

* * * * *